US006382630B1

(12) United States Patent
Dos Santos et al.

(10) Patent No.: US 6,382,630 B1
(45) Date of Patent: May 7, 2002

(54) APPARATUS FOR THE PREVENTION OF MARKING CARDS IN CARD GAMES

(76) Inventors: Jack M. Dos Santos, 263 School St., Chicopee, MA (US) 01013-2400; Patrick F. Collins, 2 Arbor La., Windsor Locks, CT (US) 06096

( * ) Notice: Subject to any disclaimer, the term of this patent is extended or adjusted under 35 U.S.C. 154(b) by 0 days.

(21) Appl. No.: 09/710,956

(22) Filed: Nov. 14, 2000

(51) Int. Cl.[7] ..... A63F 1/06
(52) U.S. Cl. ..... 273/309; 273/148 R; 273/274
(58) Field of Search ..... 273/309, 148 R, 273/274; 463/25, 29

(56) References Cited

U.S. PATENT DOCUMENTS 848,042 A * 3/1907 Musgrave
2,476,535 A * 7/1949 Denson et al.
2,490,649 A * 12/1949 Polis
5,788,574 A * 8/1998 Ornstein et al.
5,823,875 A * 10/1998 Tarantino

OTHER PUBLICATIONS

Greenline Products publication titled "GREENLINE PRODUCTS".
Cott Manufacturing Company publication with the heading "The STREET FINK . . .".

* cited by examiner

*Primary Examiner*—Benjamin H. Layno
(74) *Attorney, Agent, or Firm*—Ross, Ross & Flavin

(57) ABSTRACT

A transparent shield is provided for a blackjack or other card table for use by a dealer and players for playing a card game, the shield having a closed front face and an open rear face for providing a space above the table accessible by the dealer for dealing the cards but denying access to the players, thereby preventing marking of the playing cards.

9 Claims, 3 Drawing Sheets

APPARATUS FOR THE PREVENTION OF MARKING CARDS IN CARD GAMES

BACKGROUND OF THE INVENTION

1. Field of the Invention

The invention relates to apparatus for preventing the marking of playing cards in card games and, more particularly, to shields for card tables or blackjack tables for preventing marking of playing cards.

2. Description of the Prior Art

While there are devices available for preventing card counting, applicants are not aware of any device for preventing card marking.

In card games such as blackjack, "marking cards" Is a phrase used to describe any act performed upon a playing card by a dealer, player or other individual, which enables the actor to recognize that card when visible. The act of "marking cards" constitutes cheating and gives the player/individual a substantial advantage in card games and especially in blackjack type games.

The prevention of "marking cards" maintains the integrity of blackjack type games and will enable the games to be played for a longer duration using the same decks of cards if the dealer or a casino so desires.

SUMMARY OF THE INVENTION

Accordingly, it is primary object of the present invention to provide a shield for a blackjack or other card table to prevent the marking of playing cards.

The apparatus of the invention comprises a transparent shield, which can be either portable or permanently affixed to a blackjack table. The device is transparent to permit the playing cards to be viewed collectively by the players, dealer and overhead security cameras, has a closed front face for denying access to players to the playing cards and an open rear face for permitting access to a dealer to the playing cards.

Use of the apparatus hereof will prevent the players from "marking" the cards and will not substantially alter the rules of the game.

The apparatus will also eliminate the practice of "crimping"; that is, bending or making an indention on the top or side edge of the card.

With the apparatus hereof, "Dirty money", that is, losing bets picked up by the dealer, can be picked up immediately after a losing hand while the losing hand is still under the transparent shield, thereby preventing the practice of "pinching"; that is, illegally taking cheques from a bet after cards have been dealt.

The apparatus will also protect against "Daub"; that is, applying rouge, lipstick or any type of coloring to allow a person to identify a card.

Wagers by players may be placed on the top of the apparatus in a designated area. Any cheques outside of this designated area would be considered to be a "no bet".

By use of this apparatus, players will be unable to handle the cards after the cards are dealt. Once the cards are dealt by the dealer, a player may elect to "hit"; that is, the process of asking to be dealt additional cards by simply tapping the shield.

Any payoffs by the dealer will be placed on the apparatus for easy access by the player.

DESCRIPTION OF THE PREFERRED EMBODIMENTS

Figure 1:
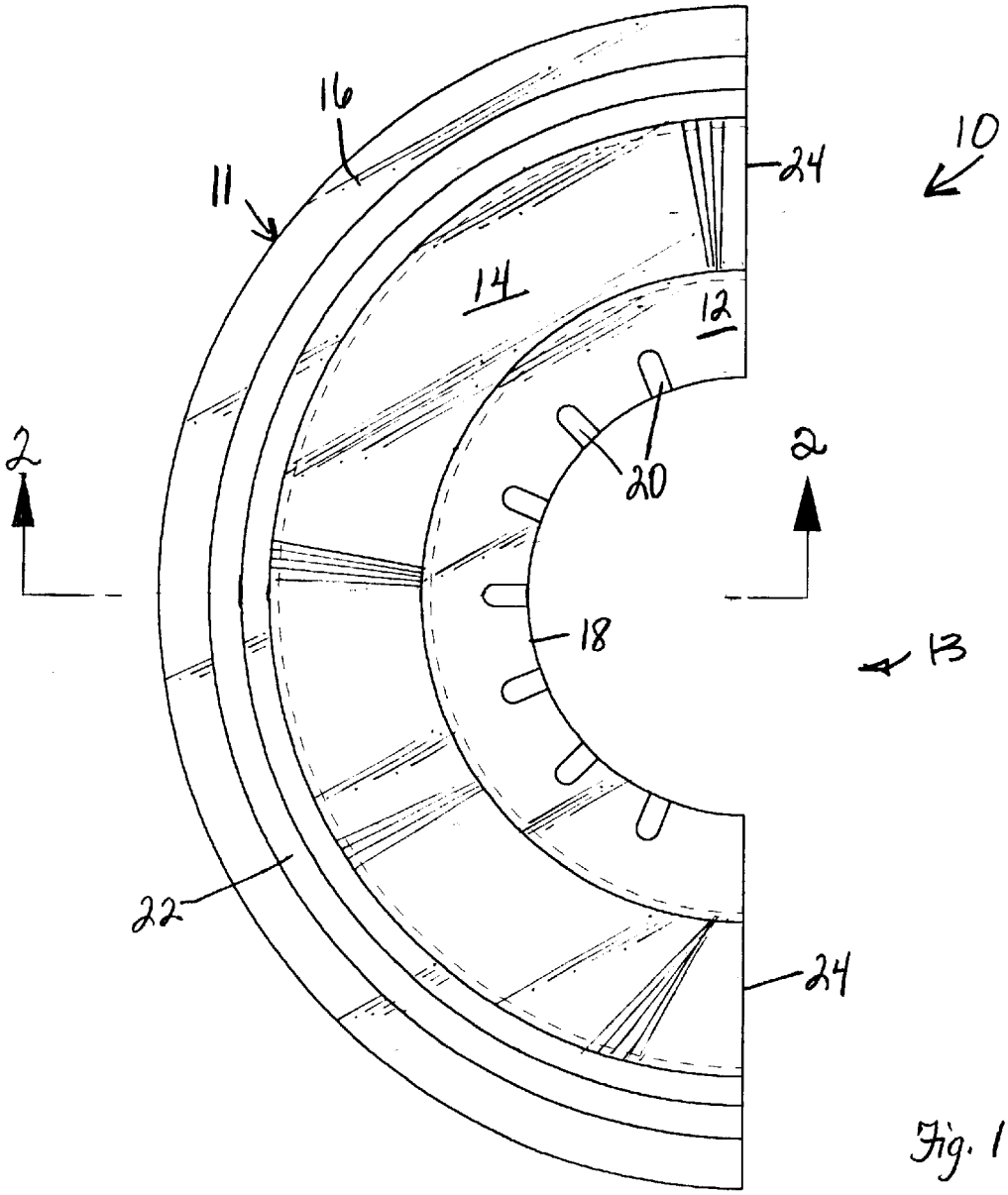
FIG. 1 is a top plan view of apparatus in the form of a transparent shield embodying the invention.
Figure 2:
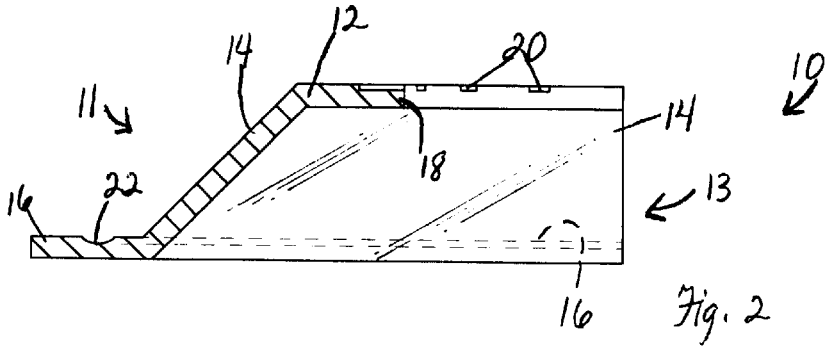
FIG. 2 is a cross sectional view taken on line 2—2 of FIG. 1.
Figure 4:
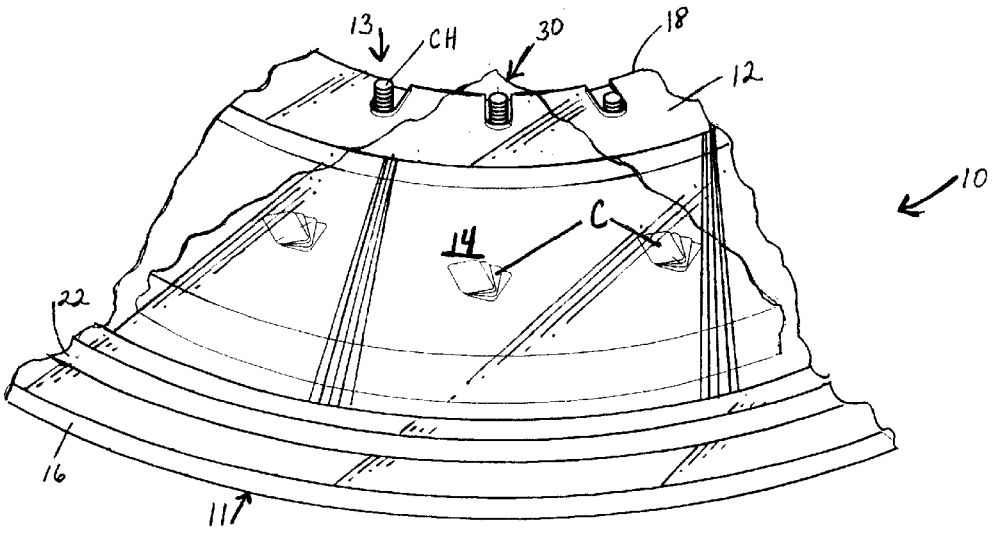
FIG. 4 is a fragmentary front perspective view of a portion of the shield of FIGS. 1–3 in association with a portion of a blackjack card table.

Referring to FIG. 1 and 2, apparatus embodying the invention comprises a transparent shield generally indicated by 10, which is semicircular in plan and substantially fusto-conical in elevation, has a closed front face 11 and an open rear face 13.

Shield 10 includes as an integral unit, a flat, horizontally disposed, semi-circular top wall 12, an inclined, semi-circular intermediate wall 14, and a flat, horizontally disposed, semi-circular bottom wall 16.

The Inner, peripheral edge of top wall 12 merges with the top edge of intermediate inclined wall 14, while the inner edge of bottom wall 16 merges with the lower edge of intermediate inclined wall 14 to form an integral unit.

The outer, peripheral edge of top wall 12 is provided with a semicircular cut-out 18, while the top face of top wall 12 is provided with a series of short, equally-spaced radially-positioned, indentations 20 which open into cut-out 18, for purposes to appear.

A semi-circular groove 22 is provided approximately centrally of the upper face of lower wall 16 and extends for the length of the lower wall, also for purposes to appear.

Figure 3:
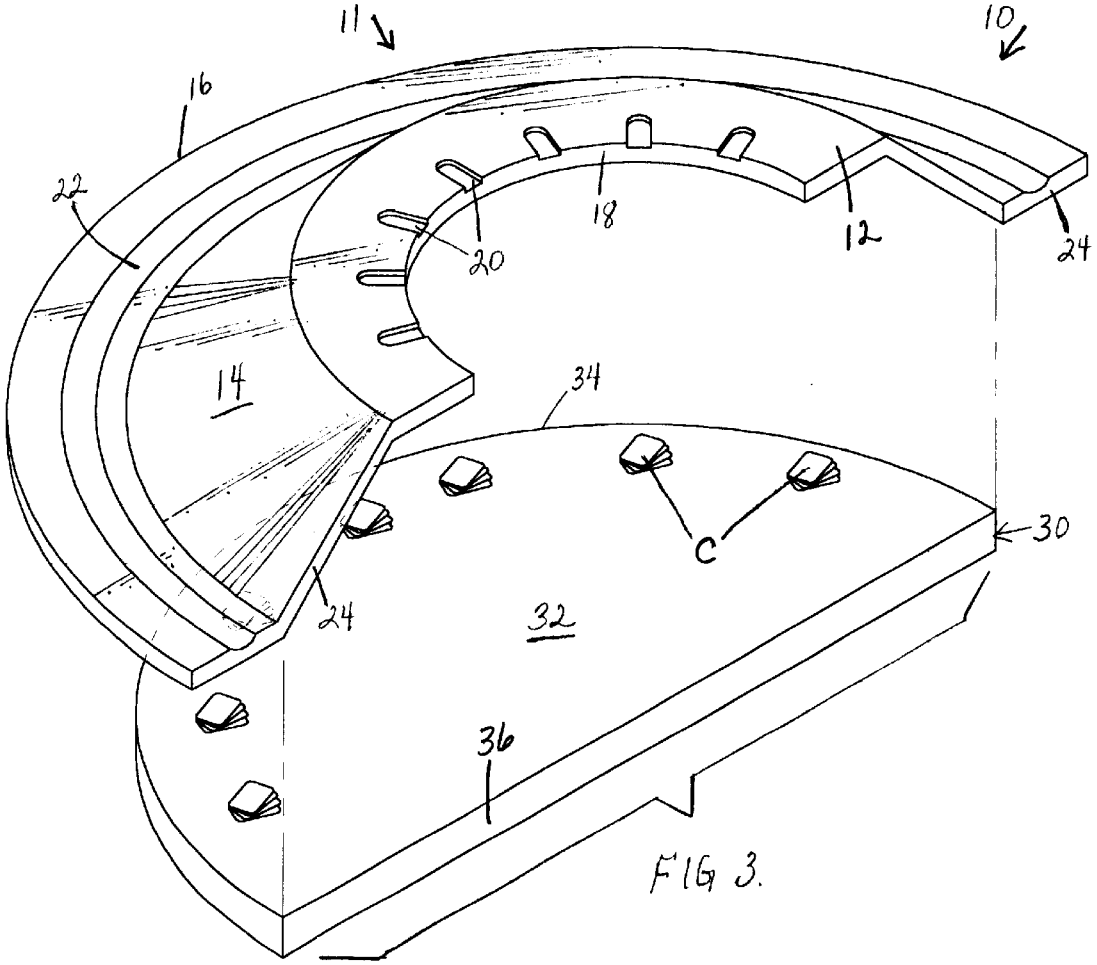
FIG. 3 is an exploded top perspective view of the shield of FIG. 1 in association with a blackjack card table.
Figure 5:
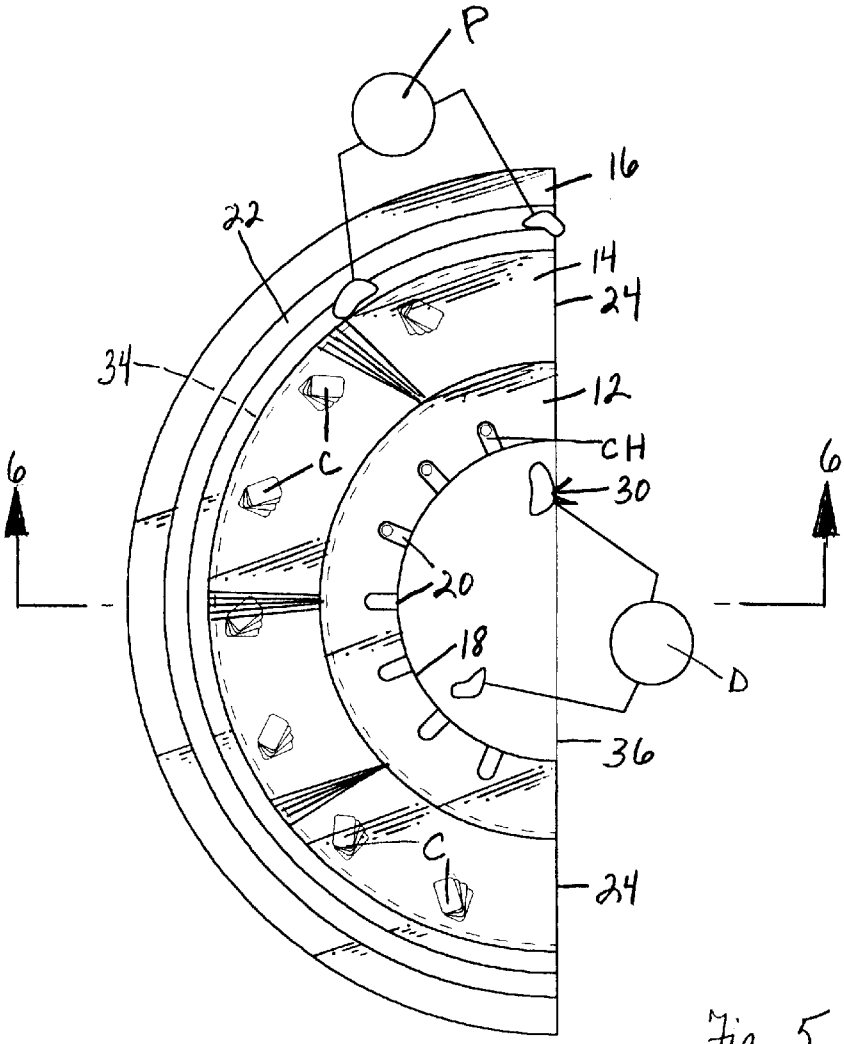
FIG. 5 is a top plan view of the shield of FIGS. 1–4 in association with a blackjack card table and illustrating the relative positions of a player and dealer.

The innermost ends of walls 12, 14 and 16 are flat and provide an integral, vertically disposed, inner wall 24, which extends transversely across the diameter of the shield, as clearly shown in FIG. 3.

As shown in FIGS. 3–6, shield 10 is employed with the usual semicircular blackjack or card table, generally indicated by 30.

Blackjack or card table 30 includes a flat, planar, horizontally disposed upper face 32, a semi-circular, vertically disposed, outer peripheral face 34, and a straight, vertically disposed inner face 36, which extends transversely across the diameter of the table.

In use, shield 10 is positioned so that a portion of the lower face of its bottom wall 16 rests on upper face 32 of table 30 slightly inwardly of table peripheral edge 34, with inner wall 24 of shield 10 being aligned with inner face 36 of the table.

Shield 10 may optionally be permanently affixed to table 30; or it may simply rest on the table and remain portable.

Figure 6:
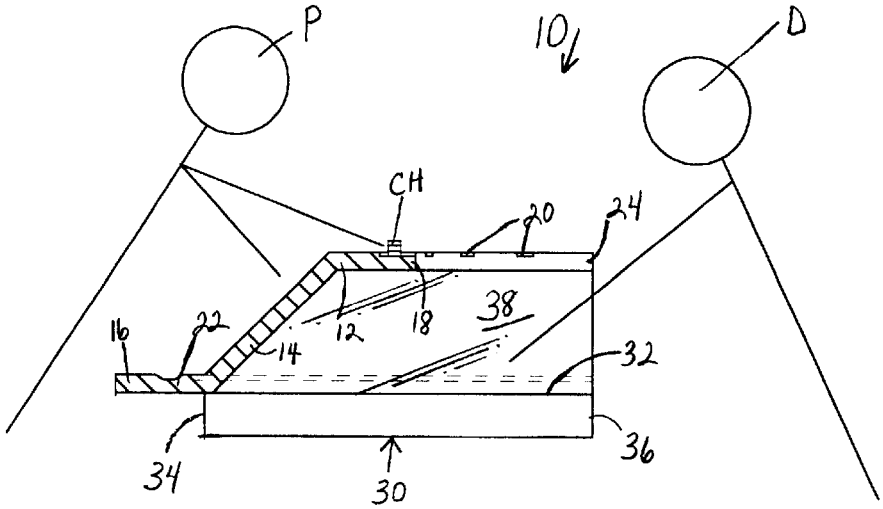
FIG. 6 is a cross sectional view taken on line 6—6 of FIG. 5.

As seen in FIG. 6, due to the unique substantially frusto-conical, configuration of shield 10, when it is positioned on table 30, top wall 12 of the shield is disposed in spaced parallelism to and above upper face 32 of the table to form a playing card space 38 between top wall 12 of the shield and upper face 32 of the table.

Cut out 18 and open rear face 13 makes playing card space 38 easily accessible to a dealer D.

However, playing card space 38 is inaccessible to a player P, the player being denied access to that space by inclined intermediate wall 16 of closed front face 11 of the shield, thereby effectively precluding marking of the cards by the player.

Groove 22 in the upper face of bottom wall 16 of shield 10 provides a convenient space for players to keep their betting chips.

Playing cards C are dealt by dealer D to players P and placed on upper face 32 of table 30 under shield 10 in playing card space 38 at player positions which are aligned with indentations 20 in top wall 12 of the shield.

Players P wager or make bets by placing their chips CH in the indentations 20 opposite their respective positions.

Since the shield is transparent, the players, the dealer, onlookers, or surveillance personnel can clearly view the playing cards and the amounts and the number of chips wagered.

At no time do the players have access to the playing cards whereby card marking is effectively precluded, while the chips are readily accessible, permitting easy removal of the chips from the shield by the dealer, since the open ends of slots 20 face the dealer.

What is claimed is:

1. In combination with a card table for use by a dealer and players for playing a card game, the improvement which comprises, a transparent shield disposed on the upper surface of the card table, the shield having integral means providing a card playing space between said upper surface of the card table and the shield, and having means permitting access to the card playing space by the dealer for handling the playing cards while denying access to the card playing space by the players, thereby preventing marking of the playing cards by the players.

2. In the combination according to claim 1, wherein the card table and the transparent shield are semi-circular in plan and wherein the transparent shield has a closed front face and an open rear face and is substantially frusto-conical in elevation.

3. In the combination according to claim 1, wherein the transparent shield forms an integral unit which is substantially frusto-conical in elevation and wherein the card playing space is defined by a top wall of the shield which is disposed in spaced parallelism to and above the card table and is joined to an inclined intermediate wall which is joined to a bottom wall which rests on the card table, the inclined intermediate wall forming a barrier for denying access by the player to the card playing space.

4. In the combination according to claim 3, wherein the top wall has an upper surface which is provided with a series of spaced, indentations for receiving therein player betting chips for placing wagers.

5. In the combination according to claim 3, wherein the bottom wall is provided on an upper face with a groove for holding player betting chips.

6. In the combination according to claim 3, wherein the top wall has an upper surface which is provided with a series of spaced indentations for receiving therein player betting chips for placing wagers, the indentations each having an open end which faces the dealer.

7. In the combination according to claim 1, wherein the means permitting access to the card playing space by the dealer is an open rear face and a cutaway portion of the transparent shield.

8. In the combination according to claim 1, wherein the shield is permanently affixed to the card table.

9. In the combination according to claim 1, wherein the shield is portable.

* * * * *